US007520826B2

(12) United States Patent
Guptill

(10) Patent No.: US 7,520,826 B2
(45) Date of Patent: Apr. 21, 2009

(54) APPARATUS FOR A GAME HAVING A GOAL AREA

(76) Inventor: Brian Guptill, Box 190, St. Laurent, Manitoba, R0C 2S0 (CA)

( * ) Notice: Subject to any disclaimer, the term of this patent is extended or adjusted under 35 U.S.C. 154(b) by 105 days.

(21) Appl. No.: 11/674,907

(22) Filed: Feb. 14, 2007

(65) Prior Publication Data

US 2007/0191147 A1 Aug. 16, 2007

Related U.S. Application Data

(60) Provisional application No. 60/772,866, filed on Feb. 14, 2006.

(51) Int. Cl.
*A63B 67/00* (2006.01)
*A63B 57/00* (2006.01)

(52) U.S. Cl. ..... 473/465; 473/187; 473/189

(58) Field of Classification Search ..... 473/465, 473/476, 415, 187, 185, 160; 273/400, 401, 273/336, 127 R, 126 R; D21/790, 791
See application file for complete search history.

(56) References Cited

U.S. PATENT DOCUMENTS 1,112,075 A * 9/1914 Lush ..... 473/189
1,208,838 A * 12/1916 Rolfe ..... 473/187
1,229,766 A * 6/1917 Long ..... 473/187
1,427,537 A * 8/1922 Long ..... 473/187
1,687,217 A * 10/1928 Kurtz ..... 473/185
1,893,402 A * 1/1933 Ehrlich ..... 473/185
2,788,977 A * 4/1957 Lusk ..... 473/187
2,951,704 A * 9/1960 Neiler ..... 473/185
3,338,579 A * 8/1967 McKain ..... 273/127 R
4,256,308 A * 3/1981 Schlueter et al. ..... 473/189
4,359,225 A * 11/1982 Baldorossi et al. ..... 473/187
5,655,776 A * 8/1997 Kaulfuerst ..... 473/187

* cited by examiner

*Primary Examiner*—Gene Kim
*Assistant Examiner*—Mike Chambers
(74) *Attorney, Agent, or Firm*—Ade & Company Inc.; Ryan W. Dupuis; Kyle R. Satterthirrute

(57) ABSTRACT

An apparatus, used as a goal in a game with a game ball and club, comprises a frame arranged to be supported on the ground which defines a perimeter boundary surrounding a goal area sustantially at ground level and a goal mouth extending at least partway about the perimeter boundary substantially at ground level. The goal mouth fully surrounds the goal area and provides access of the game ball therethrough to the goal area. A retaining mechanism comprises a plurality of gates selectively spanning the goal mouth to control entry and exit of the game ball to and from the goal area.

20 Claims, 4 Drawing Sheets

APPARATUS FOR A GAME HAVING A GOAL AREA

This application claims the benefit under 35 U.S.C.119(e) of U.S. provisional application Ser. No. 60/772,866, filed Feb. 14, 2006.

FIELD OF THE INVENTION

This invention relates to an apparatus for a game and more particularly to an apparatus for a game played in a manner similar to golf.

BACKGROUND OF THE INVENTION

Golf is a popular sport and miniature golf is a well known recreational activity derived from golf in which even someone relatively unskilled in the sport can partake. However, participation in each of these activities requires a laid out course and therefore conventionally requires travel to a site having such a course and payment of a fee, whether on a membership or pay-per-play basis, to a proprietor who operates and maintains the site. This arrangement may place restrictions on when an individual or party may partake in golf and/or related activities, for example through monetary and transportation requirements and the hours of operation of a course.

As a result, there is a desire for a game that can be played in a manner similar to miniature golf and can be readily setup in a variety of locations.

SUMMARY OF THE INVENTION

According to one aspect of the present invention there is provided an apparatus for use as a goal in a game using a game ball, the apparatus comprising:

a frame arranged to be supported on the ground to define:

a perimeter boundary surrounding a goal area spanning an interior of the perimeter boundary substantially at ground level; and a goal mouth extending at least partway about the perimeter boundary substantially at ground level and arranged to provide access of the game ball therethrough to the goal area; and a retaining mechanism spanning the goal mouth and being arranged to both allow entry of the game ball into the goal area through the goal mouth and prevent exit of the game ball from the goal area through the goal mouth.

The goal mouth and the retaining mechanism may extend along the perimeter boundary about at least two opposed sides of the frame whereby entry to the goal area across the perimeter boundary from ground level is achievable from said at least two opposed sides of the frame.

More preferably, the goal mouth and the retaining mechanism may extend along the perimeter boundary at a plurality of locations positioned circumferentially about the perimeter boundary whereby entry to the goal area across the perimeter boundary from ground level is achievable from said plurality of locations positioned circumferentially about the perimeter boundary.

In the illustrated embodiment, the goal mouth and the retaining mechanism fully surround the goal area about the perimeter boundary whereby entry to the goal area across the perimeter boundary from ground level is achievable in all directions.

The goal mouth is preferably sufficient in height to receive a baseball or a softball therethrough.

The retaining mechanism may comprise a plurality of gates in which each gate is supported for movement between a first position, in which the gate spans across a respective portion of the goal mouth to prevent access of the game ball into the goal area, and a second position, in which said portion of the goal mouth is substantially unobstructed by the gate member to allow access of the game ball through said portion of the goal mouth.

Each gate is preferably biased toward the first position.

There may be provided a first blocking member arranged to prevent movement of each gate beyond the first position in a direction opposite travel toward the second position. When each gate is displaced upwardly and inwardly in the second position in relation to the first position, there may also be provided a blocking member arranged to prevent movement of each gate beyond the second position in a direction opposite travel toward the first position.

The frame is preferably supported above the goal area at the perimeter boundary with the gates being suspended on the frame at the perimeter boundary for pivotal movement between the first and second positions.

When the apparatus is provided in combination with the game ball, each gate is preferably movable to the second position by engagement of the game ball during rolling motion through the goal mouth into the goal area.

The gates are preferably arranged to be freely pivotal from the second position to the first position when the game ball is generally centrally located within the goal area.

The apparatus may further be provided in combination with a club for striking the game ball to induce rolling motion thereof toward the goal area.

The frame may comprise a generally circular frame member suspending the gates therefrom and a central shaft arranged to support the circular frame member spaced above the ground.

The gates may be pivotal into a storage position lying generally in a common plane with the circular frame member. In this instance, the central shaft is separable from the circular frame member so as to be arranged to lie generally flat against the common plane of the circular frame member in the storage position.

According to another aspect of the invention there is provided a game apparatus comprising:

a perimeter boundary disposed substantially parallel to ground level;

a goal area spanning an interior of the perimeter boundary; and a retaining mechanism adapted to allow entry to the goal area across the perimeter boundary from ground level and prevent exit from the goal area across the perimeter boundary.

Preferably the goal area is two dimensional and substantially coplanar with ground level.

Preferably the retaining mechanism substantially surrounds the goal area.

Preferably entry to the goal area across the perimeter boundary from ground level is achievable in all directions.

Preferably a mouth through which entry to the goal area is achieved is defined immediately above the goal area.

Preferably the retaining mechanism comprises a plurality of obstruction elements supported for movement between first and second positions, each obstruction element obstructing exit from the goal area to ground level across the perimeter boundary in the first position and allowing entry to the goal area from ground level in the second position.

Preferably movement of each obstruction element from the first position in a direction opposite travel toward the second position is substantially blocked.

Preferably motion of each obstruction element between the first and second positions is unrestricted by adjacent obstruction elements.

Preferably the obstruction members comprise pivotal gate members hanging from a frame.

Preferably the obstruction elements return to the first position having allowed entry of the ball into the goal area.

Preferably the goal area is substantially circular.

BRIEF DESCRIPTION OF THE DRAWINGS

In the accompanying drawings, which illustrate exemplary embodiments of the present invention.

In the drawings like characters of reference indicate corresponding parts in the different figures.

DETAILED DESCRIPTION

Figure 1:
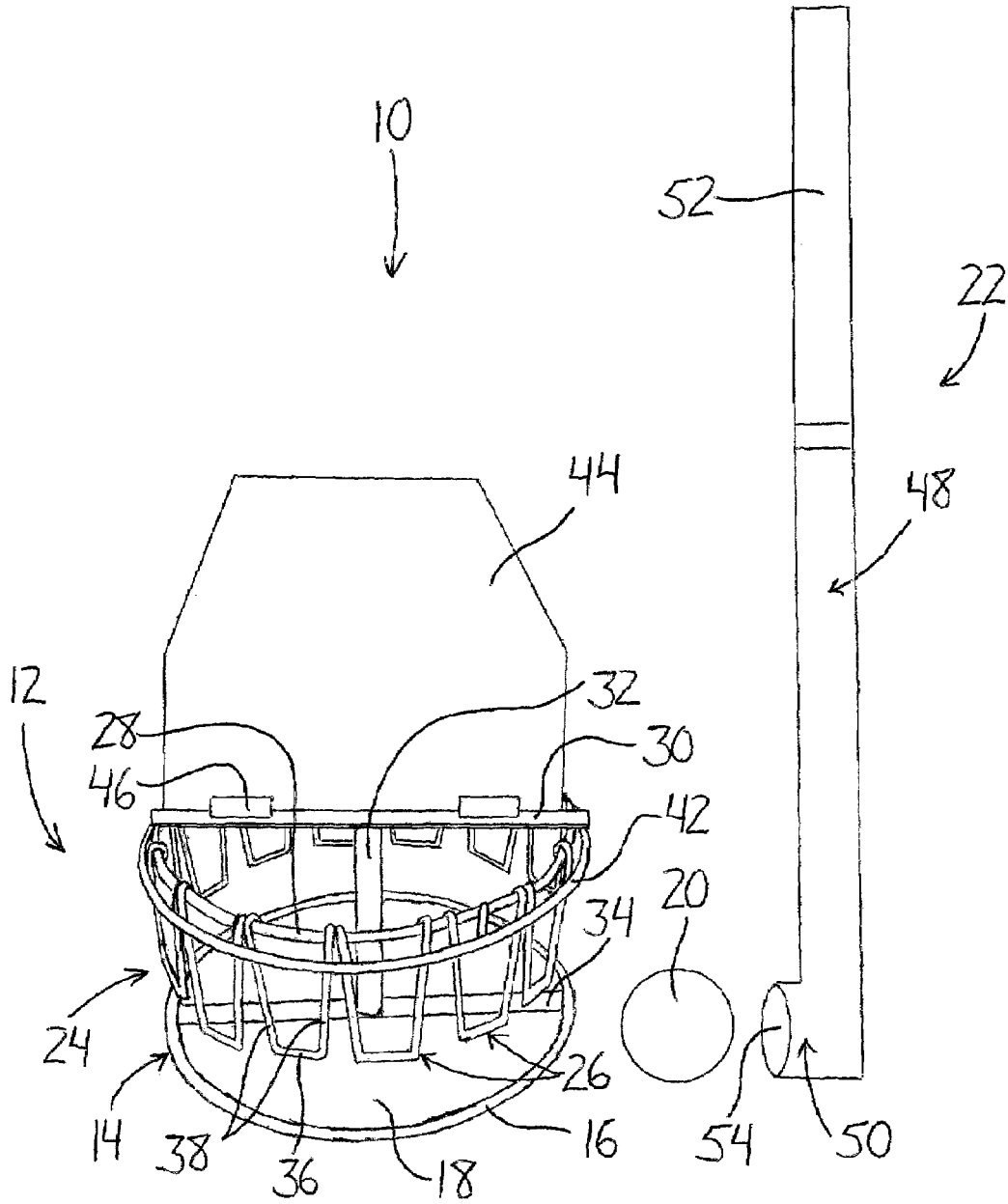
FIG. 1 is a perspective view of a game apparatus, a ball and a club.

Shown in FIG. 1 is an apparatus for playing a game that is played in a manner similar to miniature golf, but that does not require a prefabricated course. The apparatus 10 features a frame 12 having a base 14 for sitting upon a ground surface. The base 14 includes a ring 16 forming a perimeter which defines a goal area 18 within the ring. The game is played with a ball 20 and a club 22. A swinging motion of the club 22 is used to hit the ball 20 in an attempt to roll it over the ring 16 into the goal area 18. Played similar golf, the ball is first hit from a predetermined starting point and the number of strokes taken in reaching the goal area is counted, with a lower score therefore being better than a higher one. Definition of a goal area 18 coplanar with the ground surface by the apparatus 10 eliminates the need for sunken holes as used in golf such that the game can be played on essentially any surface. Therefore a game similar to miniature golf can be played, for example, at home without having to travel to and pay for use of a conventional miniature golf course.

The apparatus 10 includes a retaining mechanism 24 for preventing exit of the ball 20 from the goal area upon entry thereto over the ring 16. The retaining mechanism is made up of a plurality of hanging gates 26 extending around the goal area 18. The gates 26 hang from a support ring 28 that is supported on an upper cross member 30 that extends diametrically across the goal area 18. The upper cross member 30 is supported atop a vertical shaft 32 centrally disposed in the goal area 18 to elevate the upper cross member therefrom. A lower cross member 34 extends diametrically across the base ring 16 to connect the shaft 32 and base 14 of the frame 12.

In the exemplary embodiment, each gate is formed by a rod bent to form a horizontally disposed central portion 36 having upward extending leg portions 38 at either end thereof and a hook 39 formed at an end of each leg portion opposite the central portion. The hooks 39 extend over the support ring 28 to hang the gate 26 and support it for pivotal motion about the support ring 28. Each gate 26 is sized such that a space left between the central portion at the bottom thereof and the base ring 16 is smaller in height than the ball 20. This means that the ball 20 cannot enter the goal area 18 by rolling over the rim 16 without pushing the gate inward toward the centrally disposed shaft 32.

Figure 2:
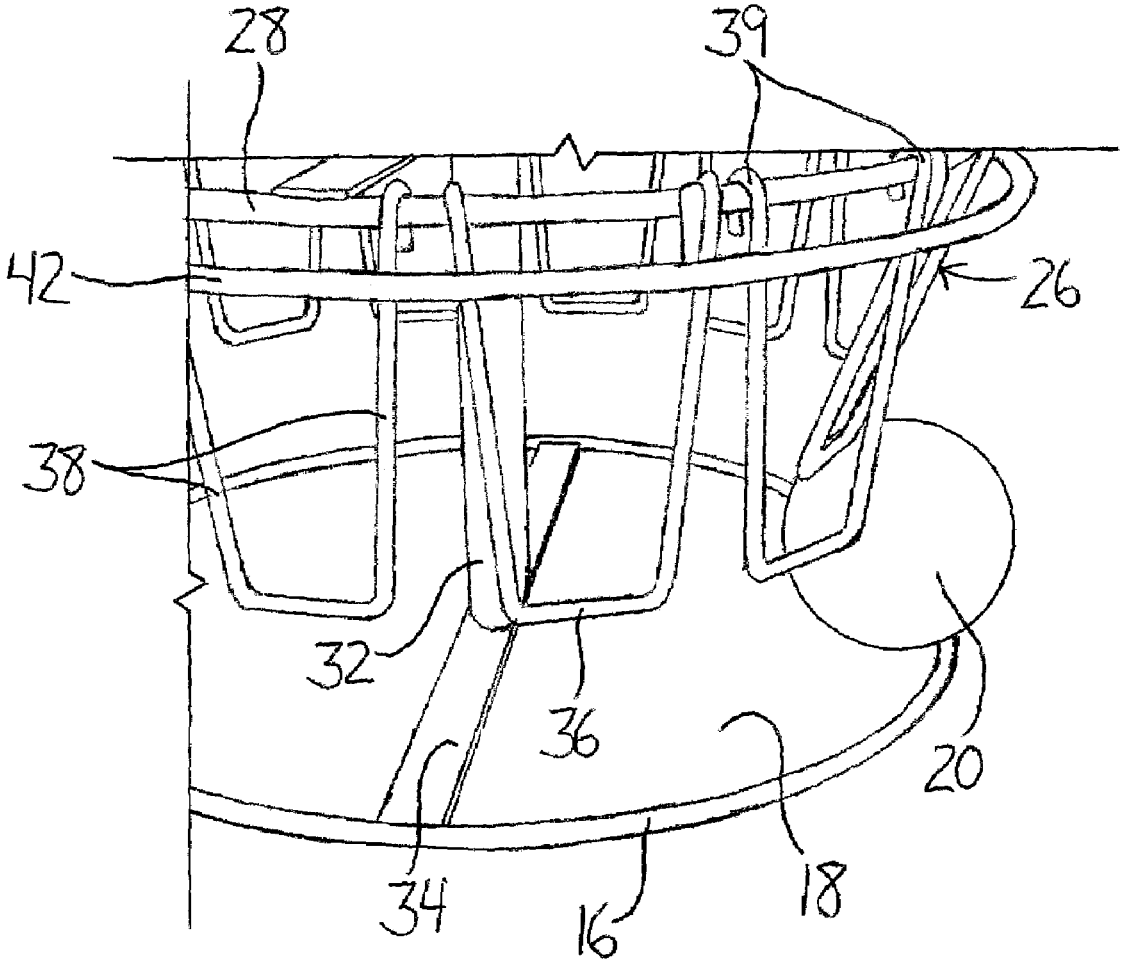
FIG. 2 is a partial perspective view the game apparatus and ball of FIG. 1 illustrating entry of the ball into a goal area of the apparatus.

As shown rolling into the goal area 18 in FIG. 2, the ball 20 pushes the gate 26 from a first hanging position, in which the gate obstructs entry to the goal area, pivotally toward a second position in which the central portion 36 is raised to the height of the ball 20. When the central portion 36 passes over the center of the rolling ball 20, the gate 26 is then free to pivot back toward the original hanging position, to which it is biased by gravity. A blocking ring 42 having a diameter slightly larger than the support ring 28 is concentrically supported therebelow to encompass the hanging gates 26. The blocking ring 42 prevents pivotal motion of the gates 26 radially outward (with respect to the rings 16, 28, 42) from the hanging position shown in FIG. 1. This means that the gates 26 can each swing inward to allow the ball 20 to enter the goal area 18, but cannot swing outward to allow exit of the ball once having so entered. In other words, the retaining mechanism 12 prevents exit of the ball 20 from the goal area 18 over the base ring 16 in any direction, instead requiring the ball 20 to be manually lifted out of the goal area from above.

A second blocking ring may be provided concentric to the support ring 28 above and/or just inside thereof to prevent flipping of the gates over the support ring to extend outside the illustrated blocking ring 42. Looking at the drawings, it should be appreciated that when rolling with excessive speed, contact of the ball with a gate may cause it to pivot about the support ring to such an extent that it flips completely over to the outside of the illustrated blocking ring 42. In such a position the gate would act in a reverse manner, allowing exit and preventing entry of a ball 20, due to the relative positioning of the gate and blocking ring 42. A second blocking ring supported above and or inside the support ring 28 would block the gates from flipping over to the outside of the illustrated blocking ring 42, thereby limiting motion of the gates about the support ring to ensure that they are always arranged to allow entry and prevent exit, and not vice versa. It should be appreciated that a second blocking element may have forms other than a ring, so long as it achieves the same effect of limiting the gate motion without obstructing removal of the ball 20 from above the apparatus 10.

By preventing exit from the goal area, the retaining mechanism 12 ensures that even in high speed rolling motion, a ball 20 having entered the apparatus will remain therein. This differs from putting in golf, where a ball hit too hard will tend to skip over or out of the hole and increase the player's score. The apparatus 10 of the present invention, therefore allows players of varying skill to play together with the possibility of a more balanced score between them. In other words, while aim is certainly required for the ball 20 to reach the apparatus 10 in a relatively low number of strokes, precise velocity control may not be as significant in determining a player's score.

A vertical space between the base ring 16 and the blocking ring 42 defines a mouth through which the ball 20 must pass to enter the goal area 18. The hanging gates 26 are shaped to ensure that two adjacent gates do not overlap in space at any point in time. In other words, two neighbouring gates commonly pushed by a ball can each move toward the second position at the same time without interference from the other.

At the same time, it is desirable to keep the hanging gates 26 in relatively close fitted arrangement about the support ring 28 so that there is not enough room between any two gates to allow the ball 20 to exit the goal area 18 between them. As a result, each gate 26 is tapered from top to bottom by convergence of its leg portions toward its central portion at its lower end opposite the support ring 28. The gates are thus closely spaced at the support ring 28 but sufficiently spaced at along their lengths so as not to contact one another during pivotal motion about the support ring 28. Each gate is long enough to hang down past the height of the ball 20, but is shorter than the radius of the support ring 28 so that it won't jam against the central shaft 32 during pivotal motion.

As seen in FIG. 1, the apparatus 10 features a sign panel 44 detachably mounted on the upper cross member 30 by clamping elements 46 disposed in a spaced manner therealong. The sign panel 44 may be used to display indicia for providing information relevant to the game. For example, a plurality of apparatuses may be used to lay out a course having a plurality of goal areas, similar to a miniature golf course having a plurality of holes. In such a case, the sign panel may be used to number the multiple apparatuses to indicate the order in which their play is to be completed and/or indicate par for each individual apparatus. Par is a well-known term used in golf to indicate a standard against which a player's score may be measured.

FIG. 1 shows a club 22 for use with the apparatus 10 and the ball 20. The club 22 features an elongate shaft 48 having a head 50 and a handle, or grip, 52 disposed at opposite ends. The grip 52 is held in the hands of a player to swing the club 22 to strike the ball 20 with a face 54 of the head 50. The face 54 is disposed substantially parallel to the shaft 48 and offset to one side thereof. The apparatus may be sized for use with a ball of another game or sport, for example a baseball or softball. This allows the game to be played without having to purchase a ball for the specific purpose of playing the game. A user may therefore use a all already in their possession or purchase a new ball that can be used for more than one particular activity.

The apparatus 10 may be modular in assembly to allow collapse to a more compact state for storage. In such a case, the vertical shaft 32 is detachable from each of the upper and lower cross members 30, 34 to separate the base 14 from the retaining mechanism 24. It should be appreciated that the retaining mechanism 24, including the upper cross member 30, support ring 28, hanging gates 26 and blocking ring 42, can be collapsed in height to be laid atop a flat surface by pivoting hanging gates 26 to extend radially inward from the support ring 28. Thus, the removed sign panel 44, shaft 32, base 14 and retaining mechanism can all be laid, or stacked, on a horizontal surface for storage in a vertically compact arrangement. Different types of detachable connection are well known and can be applied to the apparatus to provide its collapsibility. For example, a hollow center of the shaft 32 may be sized to receive upward and downward vertical projections on the lower and upper cross members 34, 30 respectively so that the shaft 32 and retaining mechanism 24 are simply stacked atop one another for assembly.

Figure 3:
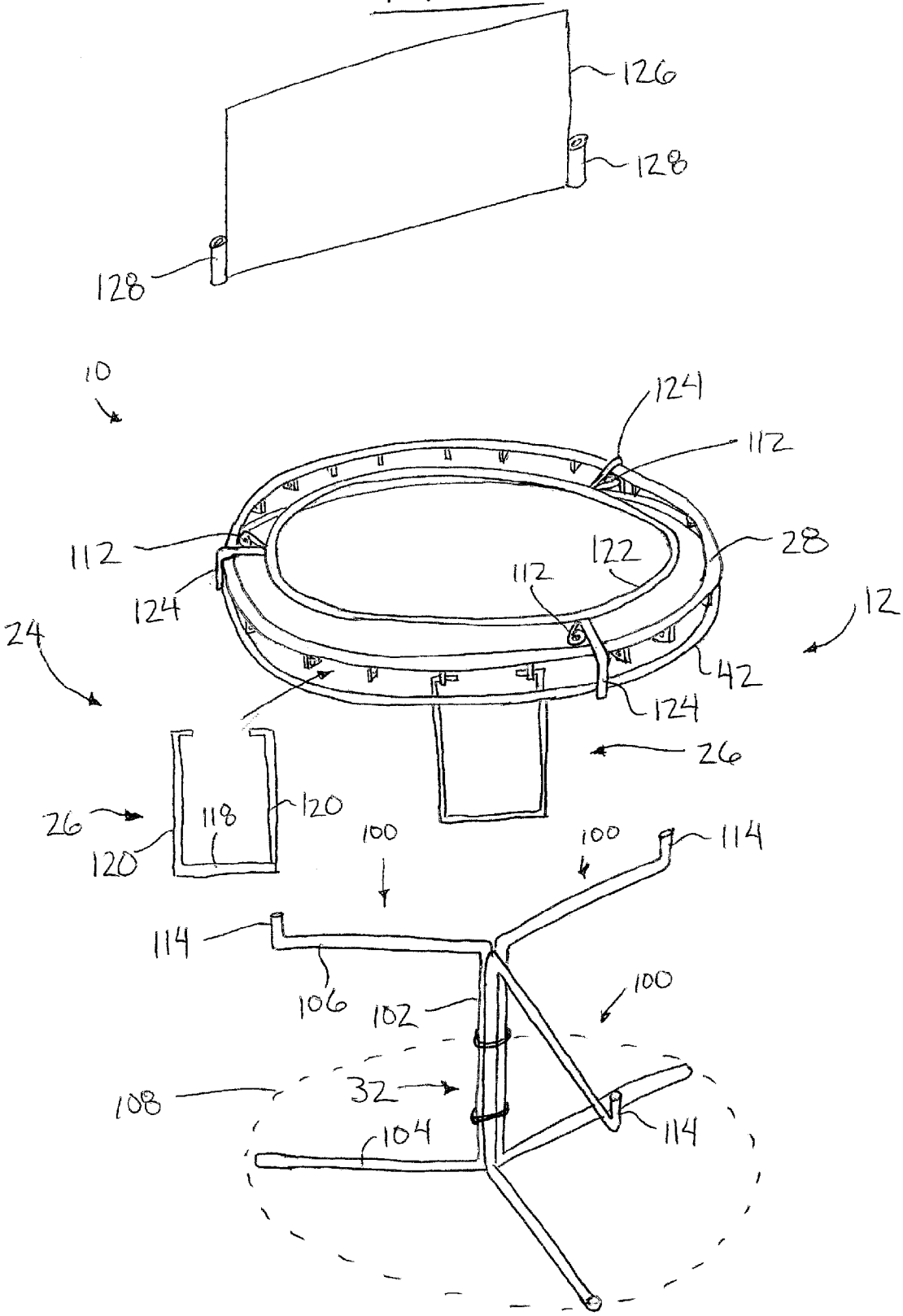
FIG. 3 is an exploded perspective view of a second embodiment of the apparatus according to the present invention.
Figure 4:
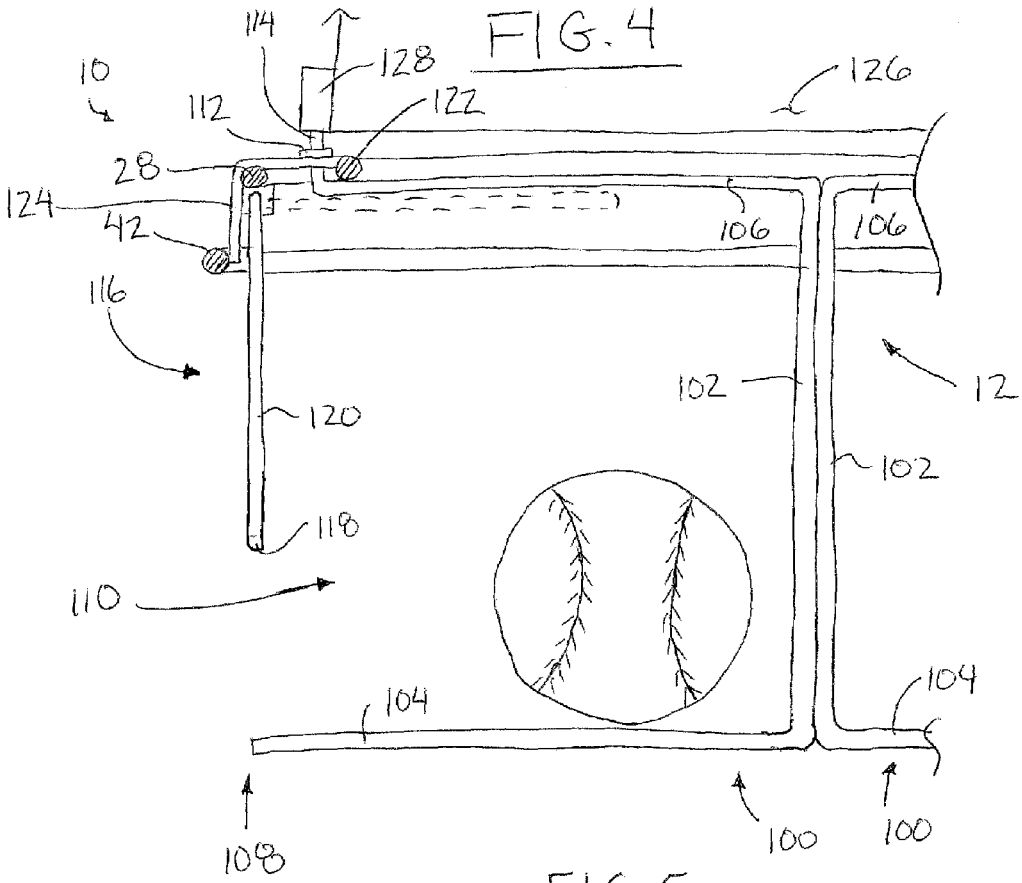
FIG. 4 is a partly sectional elevational view of the apparatus according to FIG. 3 once assembled in use in which the gate is shown in a first position in solid line and in a second position in broken line.
Figure 5:
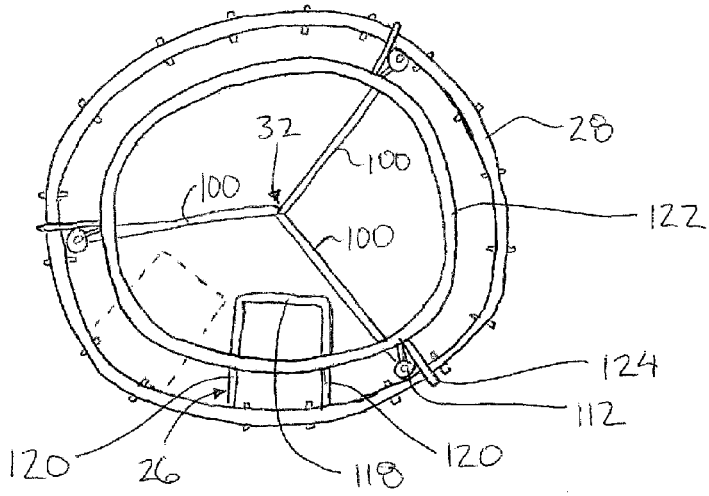
FIG. 5 is a top plan view of the apparatus according to FIG. 3 in which one of the gates is in the second position.

Turning now to FIGS. 3 through 5, a second embodiment of the apparatus 10 is shown. In the second embodiment, the apparatus is played in a game similarly to the previous embodiment in which a ball, for example a baseball but preferably a softball, is directed at the apparatus 10 which acts as a goal for recording points in the game. The apparatus 10 is particularly suited for playing a game having rules which are similar to golf.

The apparatus 10 includes a frame 12, which in the second embodiment is collapsible, comprised of three base frame members 100 which are moveably connected to one another for movement between an in use position shown in FIGS. 3 through 5 and a collapsed position for storage in which the three members 100 all lie flat generally against one another in a common plane.

Each of the three frame members 100 is comprised of a vertical post 102 joined integrally with a foot 104 at a bottom end and a support arm 106 at a top end thereof. The foot 104 and the support 106 are generally parallel to one another and spaced apart at opposing ends of the respective post 102 to form a generally U-shaped structure of each member 100. A suitable collar or fastener secures the three posts 102 alongside one another for relative pivotal movement about the respective longitudinal axis of the post. The three posts 102 of the members 100 respectively together form a central shaft 32 of the frame similar to the previous embodiment.

The foot and the support arm of each member projects radially from the posts 102 defining the central shaft 32 a distance which corresponds approximately to a radius of the support ring 28 supported thereabove which defines the perimeter boundary 108 which surrounds the goal area 110 lying horizontally on the ground in use within the perimeter of the boundary 108 as defined by a circular area joining the free ends of the feet 104 of the members 100 or the perimeter defined directly below the support ring 28.

The support ring 28 is arranged similarly to the previous embodiment to define the upper portion of the frame 12. The support ring comprises a circular frame member supported on the free ends of the support arm 106 of the three members 100. Eyelets 112 are provided at circumferentially spaced positions about the support ring 28 so as to be evenly spaced relative to one another and arranged for receiving pins 114 formed to extend vertically upward from respective free ends of the support arms 106. The support ring thus rests on top of the support arms 106 and is maintained in position by mating connection of the pin 114 being received within the eyelets 112 respectively.

The support ring is arranged to be supported by shaft 32 of the frame members 100 to lie generally horizontally spaced above the ground and directly above the defined perimeter boundary 108 of the goal area. The support ring 28 of the frame 12 is suspended spaced above the ground by the central shaft 32 so that a goal mouth 116 is defined about a full perimeter of the goal area so as to fully surround the goal area and provide access to the goal area by the game ball. The goal mouth 116 is thus arranged to provide access to the goal area from a plurality of opposed directions and a plurality of positions spaced circumferentially about a full perimeter of the frame.

As in the previous embodiment a retaining mechanism 24 is provided in the form of a plurality of obstruction elements or gates 26 which are suspended from the support ring 28. Each gate 26 is generally U-shaped having a bottom bar 118 and two side bars 120 joined therewith in a generally U-shaped configuration. The space between the two side bars 120 is arranged to be narrower than the game ball to prevent access of the game ball therebetween. Furthermore the gates are positioned adjacent one another at circumferentially spaced positions about the support ring 28 such that the side bars 120 of two adjacent gates are also spaced apart by a distance which is less than the diameter of the game ball to prevent the game ball being passed therebetween. The space between adjacent gates is only slightly less than the width of each gate. The gates are supported on the support ring 28 by lugs supported at prescribed circumferentially spaced positions. Each gate is supported by two lugs spaced apart by a circumferential spacing which is slightly less than the width of the gate. Hook ends are provided in the upper ends of the side bars 120 of the gates opposite the bottom bar 118 in which the hook ends project inwardly towards one another for being engaged within respective apertures in the lugs associated with that gate.

Each gate is arranged to be pivoted between a first position extending generally vertically downward from the support ring a sufficient distance that the bottom bar 118 is position sufficiently close to the ground that the game ball is not permitted to pass between the bottom bar 118 and the ground without displacing the gate. Each gate 26 thus blocks a respective portion of the goal mouth 116 in the first position.

Each gate 26 pivots from the first position radially inwardly towards a second position pivoted upwardly in relation to the first position to a generally horizontal orientation in which the goal mouth 116 is substantially unobstructed by the gate to permit access of the game ball across the perimeter boundary into the goal area. The gates are freely hinged on the support ring so that gravity biases the gates from the second position towards the first position.

Similarly to the previous embodiment a first blocking ring 42 is provided in the form a circular member which is only slightly greater than the support ring 28 so as to be very near or identical in diameter relative to one another. The blocking ring 42 is positioned spaced vertically below the support ring so as to prevent the gates 26 from pivoting outwardly from the first position in a direction away from the second position. Preventing displacement of the gates beyond the first position thus restricts a ball from exiting the goal area across one of the gates once the gates have been pivoted into the first position.

In the second embodiment a second blocking ring 122 is also provided which is positioned upwardly and inwardly in relation to the support ring while having a diameter which is near or preferably less than the support ring. In this arrangement the gates 26 are each prevented from pivoting upwardly beyond the second position away from the first position. More particularly the blocking ring 122 serves to prevent the gates from being rotated upwardly to an over center position in which the gates are rotated upwardly and outwardly beyond the perimeter boundary. In this arrangement the gate is always maintained within the perimeter boundary 108 so that gravity always biases the gate back to the first position.

The support ring and the two blocking rings are all fixed in position relative to one another by a set of coupling bars 124 positioned at circumferentially spaced positions corresponding to the locations of the eyelets 112.

A sign 126 is also provided as in the previous embodiment for providing indicia to indicate to a player of the game the location or other criteria about the apparatus 10 upon which the sign is mounted. The sign includes a pair of sockets 128 which are positioned at opposing ends of the sign at a spacing which corresponds to the spacing between any two of the pins 114 of the frame members 100 so that once the pins are inserted through the eyelets respectively, the sign 126 can in turn be supported thereabove by inserting the portion of the pin extending above the eyelet into the sockets 128 of the sign respectively.

The components of the apparatus 10 are suitably sized such that the bottom bars of the gates 26 are suspended spaced above the ground with a height in relation to the feet 104 of the frame members 100 which corresponds to a dimension which is greater than half the diameter of the game ball, but is preferably nearer to three quarters of the diameter of the game ball. The increased space between the bottom bar and the bottom of the frame prevents debris including grass or leaves and the like from interfering with the pivoting motion of the gates between the first and second positions thereof.

Furthermore the sum of the overall height of the gates in the first position together with the outer diameter of the game ball is arranged to be less in magnitude than a space between the support ring and the bottom of the shaft 32 at the center of the goal area. In this arrangement as the game ball nears the center of the apparatus 10, the game ball fully clears the bottom of the gate and the gate is permitted to freely return to the first position under biasing of gravity. Furthermore the first blocking ring 42 is arranged to be positioned near the support ring so that space between the blocking ring 42 and the perimeter boundary defined by the feet is arranged to be considerably greater than the diameter of the game ball so that the blocking ring 42 does not interfere with entry of the game ball across the goal mouth. In this instance the goal mouth is effectively defined between the perimeter boundary at the bottom of the frame and the blocking ring 42.

When it is desired to store the apparatus 10 according to the second embodiment, the sign is removed from the pins 114 followed by the support ring and blocking rings which are together removed from the pins as well. The gates can then all be pivoted inwardly to a generally horizontal position in a common plane with the support ring. The gates are spaced apart from one another sufficiently that when the gates are pivoted to the storage position, with the bottom bars being pivoted inwardly towards the center of the apparatus, no interference results from the bottom bars abutting one another. Folding the three frame members 100 to lie flat against one another and against the support ring then permits all components of the apparatus 10 to be folded into a generally flat configuration for storage.

The apparatus may be sold with or without one or more balls and with or without one or more clubs. Apparatuses may be sold individually or in sets. For example, a set of nine apparatuses may be sold to allow setup of a course similar to a nine-hole golf course without having to repeatedly move an individual apparatus around to create different playing layouts. Alternatively, a single apparatus can be purchased for use and easily moved around as desired. Unlike a miniature golf course, the goal area can be approached from any initial starting direction, thereby altering the approach layout without having to move the apparatus. The number of apparatuses a person desires to own may depend on the amount of space available for play, for example as defined by the person's yard size. Selling individual apparatuses allows a person to add more to their collection as they see fit.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An apparatus for use as a goal in a game using a game ball, the apparatus comprising:

a frame arranged to be supported on the ground to define:

a perimeter boundary surrounding a goal area spanning an interior of the perimeter boundary substantially at ground level; and a goal mouth extending at least partway about the perimeter boundary substantially at ground level and arranged to provide access of the game ball therethrough to the goal area; and a retaining mechanism spanning the goal mouth and being arranged to both allow entry of the game ball into the goal area through the goal mouth and prevent exit of the game ball from the goal area through the goal mouth;

the retaining mechanism comprising a plurality of gates;

each gate being supported for movement between a first position in which the gate spans across a respective portion of the goal mouth to prevent access of the game ball into the goal area and a second position in which said portion of the goal mouth is substantially unobstructed by the gate member to allow access of the game ball through said portion of the goal mouth;

and each gate comprising a bottom member and two side members joined with the bottom member in a generally U-shaped configuration with the bottom member in which the two side members are pivotally coupled to the frame for pivotal movement of the gate between the first and second positions;

and the frame comprising an upper portion and a central portion which supports the upper portion spaced above the goal area at the perimeter boundary; and the gates being suspended from the upper portion of the frame at the perimeter boundary so as to be arranged for pivotal movement between the first and second positions.

2. The apparatus according to claim 1 wherein the goal area is two dimensional and substantially coplanar with ground level.

3. The apparatus according to claim 1 wherein the goal mouth and the retaining mechanism extend along the perimeter boundary about at least two opposed sides of the frame whereby entry to the goal area across the perimeter boundary from ground level is achievable from said at least two opposed sides of the frame.

4. The apparatus according to claim 1 wherein the goal mouth and the retaining mechanism extend along the perimeter boundary at a plurality of locations positioned circumferentially about the perimeter boundary whereby entry to the goal area across the perimeter boundary from ground level is achievable from said plurality of locations positioned circumferentially about the perimeter boundary.

5. The apparatus according to claim 1 wherein the goal mouth and the retaining mechanism fully surround the goal area about the perimeter boundary whereby entry to the goal area across the perimeter boundary from ground level is achievable in all directions.

6. The apparatus according to claim 1 wherein the goal mouth is sufficient in height to receive a baseball therethrough.

7. The apparatus according to claim 1 wherein the goal mouth is sufficient in height to receive a softball therethrough.

8. The apparatus according to claim 1 wherein each gate is biased toward the first position.

9. The apparatus according to claim 1 wherein there is provided a blocking member arranged to prevent movement of each gate beyond the first position in a direction opposite travel toward the second position.

10. The apparatus according to claim 1 wherein each gate is displaced upwardly and inwardly in the second position in relation to the first position and wherein there is provided a blocking member arranged to prevent movement of each gate beyond the second position in a direction opposite travel toward the first position.

11. The apparatus according to claim 1 wherein motion of each gate between the first and second positions is unrestricted by adjacent ones of the gates.

12. The apparatus according to claim 1 in combination with the game ball wherein each gate is movable to the second position by engagement of the game ball during rolling motion through the goal mouth into the goal area.

13. The apparatus according to claim 12 wherein the gates are arranged to be freely pivotal from the second position to the first position when the game ball is generally centrally located within the goal area.

14. The apparatus according to claim 12 in combination with a club for striking the game ball to induce rolling motion thereof toward the goal area.

15. The apparatus according to claim 1 wherein the upper portion of the frame comprises a generally circular frame member suspending the gates therefrom and the central portion of the frame comprises a central shaft arranged to support the circular frame member spaced above the ground.

16. The apparatus according to claim 15 wherein the gates are pivotal into a storage position lying generally in a common plane with the circular frame member and wherein the central shaft is separable from the circular frame member so as to be arranged to lie generally flat against the common plane of the circular frame member in the storage position.

17. The apparatus according to claim 1 wherein the perimeter boundary about the goal area is substantially circular.

18. An apparatus for use as a goal in a game using a game ball, the apparatus comprising:

a frame arranged to be supported on the ground to define:

a perimeter boundary surrounding a goal area spanning an interior of the perimeter boundary substantially at ground level; and a goal mouth extending at least partway about the perimeter boundary substantially at ground level and arranged to provide access of the game ball therethrough to the goal area;

a retaining mechanism spanning the goal mouth and being arranged to both allow entry of the game ball into the goal area through the goal mouth and prevent exit of the game ball from the goal area through the goal mouth;

the retaining mechanism comprising a plurality of gates;

each gate being supported for movement between a first position in which the gate spans across a respective portion of the goal mouth to prevent access of the game ball into the goal area and a second position in which said portion of the goal mouth is substantially unobstructed by the gate member to allow access of the game ball through said portion of the goal mouth;

each gate being arranged to be displaced upwardly and inwardly in the second position in relation to the first position; and each gate comprising a bottom member and two side members joined with the bottom member in a generally U-shaped configuration with the bottom member in which the two side members are pivotally coupled to the frame for pivotal movement of the gate between the first and second positions;

and a blocking member arranged to prevent movement of each gate beyond the second position in a direction opposite travel toward the toward the first position and wherein said frame comprises an upper portion and a central portion which supports the upper portion spaced above the goal area at the perimeter boundary.

19. The apparatus according to claim 18 wherein the goal mouth and the retaining mechanism extend along the perimeter boundary at a plurality of locations positioned circumferentially about the perimeter boundary whereby entry to the goal area across the perimeter boundary from ground level is achievable from said plurality of locations positioned circumferentially about the perimeter boundary.

20. The apparatus according to claim 18 wherein there is provided a blocking member arranged to prevent movement of each gate beyond the first position in a direction opposite travel toward the second position.

* * * * *